United States Patent [19]

Miyamae et al.

[11] Patent Number: 4,657,505

[45] Date of Patent: Apr. 14, 1987

[54] DIFFERENT FUELS COMBUSTION BURNER

[75] Inventors: Shigehiro Miyamae; Takayuki Abe, both of Yokohama, Japan

[73] Assignee: Ishikawajima-Harima Jukogyo Kabushiki Kaisha, Tokyo, Japan

[21] Appl. No.: 735,636

[22] Filed: May 20, 1985

[51] Int. Cl.[4] ..... F23Q 9/00

[52] U.S. Cl. ..... 431/284; 431/174; 431/181; 110/260

[58] Field of Search ..... 431/174, 181, 182, 187, 431/188, 278, 284, 285; 110/260, 261, 262, 263, 264, 265

[56] References Cited

U.S. PATENT DOCUMENTS 3,859,935 1/1975 Walker ..... 431/284 X
4,032,287 6/1977 Blum et al. ..... 431/278 X

FOREIGN PATENT DOCUMENTS 1453853 10/1976 United Kingdom .

*Primary Examiner*—Margaret A. Focarino

[57] ABSTRACT

A different fuels combustion burner for simultaneously burning a liquid fuel and a solid fuel in which the solid- and liquid-fuel injections are separated in the circumferential direction so that the interference between the injected solid and liquid fuels can be avoided.

2 Claims, 5 Drawing Figures

DIFFERENT FUELS COMBUSTION BURNER

BACKGROUND OF THE INVENTION

The present invention relates to a different fuels combustion burner of the type for burning both a solid fuel and a liquid fuel simultaneously.

There have been designed and used varions types of burners for burning different kinds of fuels (to be referred to as "different fuels combustion burner" in this specification). For instance, such burners can simultaneously burn hard-to-ignite-and-hard-to-burn solid fuel particles such as anthracite, petroleum coke or the like with a liquid fuel such as heavy oil.

FIG. 1 generally shows a different fuels combustion burner. A liquid-fuel combustion nozzle 1 for injecting a liquid fuel such as heavy oil extends along the axis of the combustion burner and a solid-fuel combustion nozzle 2 with an annular nozzle opening is disposed to surround the nozzle. 1. Reference numeral 3 designates a nozzle tip of the nozzle 1; 4, a liquid-fuel supply line or pipe; 5, a nozzle tip of the nozzle 2; 6, a solid-fuel supply line or pipe; 7 and 8, air passages; 9 and 14, vanes; and 10, a furnace wall.

In the conventional different fuels combustion burner of the type described, the nozzle tips 3 and 5 are so designed and constructed as to cause a solid-fuel flame B to surround a liquid-fuel flame A as shown in FIGS. 2 and 3 so that an interference zone C where the flames A and B interfere with each other results. As a consequence, there arises the problem that "COM" phenomenon occurs.

"COM" phenomenon refers to one in which a liquid fuel and a solid fuel interfere and mix with each other so that a solid particle a is coated with a liquid fuel film b as shown in FIG. 4. When "COM" phenomenon occurs, the solid particles a tend to conglomerate into large masses. The outer liquid-fuel coating b burns first and then the hard-to burn solid particles a burn. Thus, the oxygen content in the atmosphere surrounding the combustion region of the solid particle a is lacked so that the combustibility of the solid particles a is remarkably degraded. As a result, there arises the problem that the combustion efficiency of the fuels is lower than that obtained when solid and liquid fuels are burned separately.

The present invention was made to overcome the above and other problems encountered in the conventional different fuels combustion burners and has for its object to separate liquid-fuel injection and solid-fuel injection from each other in a circumferential direction to eliminate the interference between the injected solid and liquid fuels, thereby preventing "COM" phenomenon and facilitating the ignition, whereby consumption of the liquid fuel, which is an auxiliary fuel, can be reduced while the combustion efficiency of the solid fuel can be considerably improved.

SUMMARY OF THE INVENTION

More specifically, the present invention solves these problems by providing a burner having liquid-fuel and solid-fuel injection nozzles defining respective ports which inject each fuel along a separate arc of a predetermined angle with respect to the circumference of the nozzles and thereby form separate and distinct successive streams of solid and liquid fuels about the circumference of the burner.

The above and other objects, effects, features and advantages of the present invention will become more apparent from the following description of a preferred embodiment thereof taken in conjunction with the accompanying drawings.

DESCRIPTION OF THE PREFERRED EMBODIMENT

Figure 1:
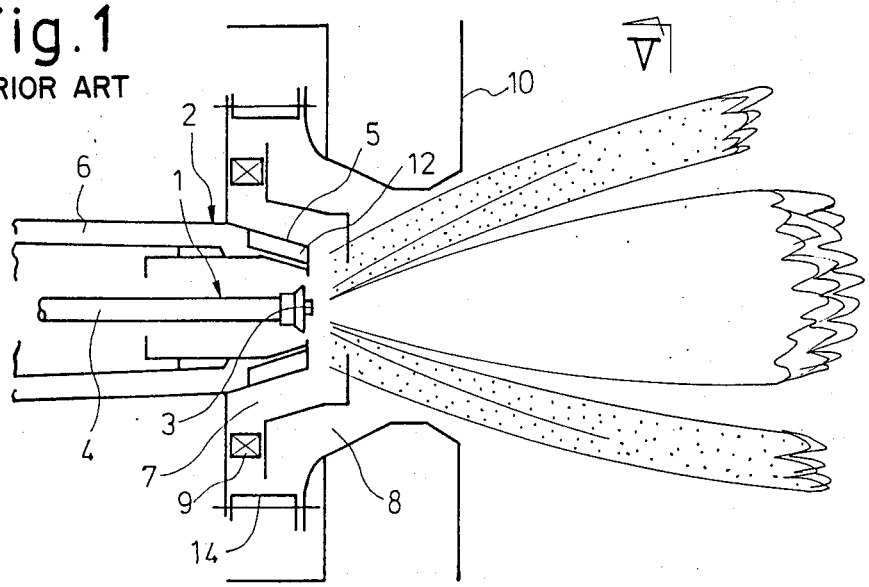
Fig.1 PRIOR ART
FIG. 1 is an axial sectional view of a different fuels combustion burner in general.
Figure 2:
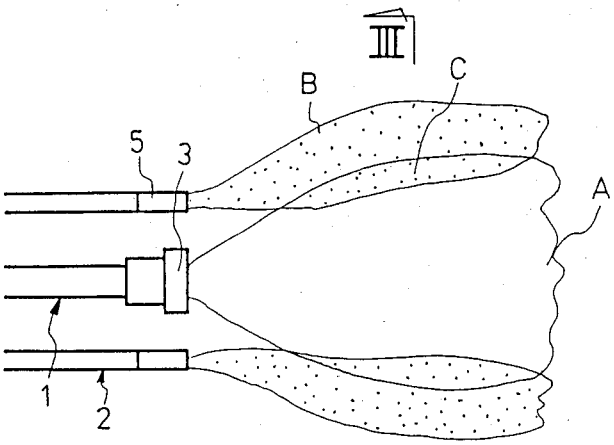
Fig.2 PRIOR ART
FIG. 2 is a view used to explain the flows of solid and liquid fuels discharged from conventional different fuels combustion burner.
Figure 3:
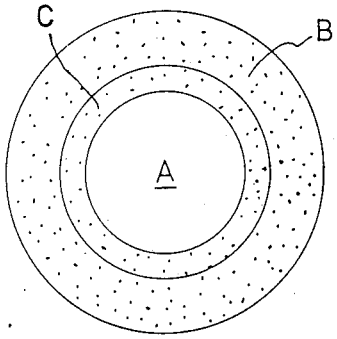
Fig.3 PRIOR ART
FIG. 3 is a view looking in the direction indicated by an arrow III in FIG. 2.
Figure 4:
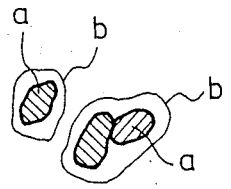
FIG. 4 is a view used to explain "COM" phenomenon.
Figure 5:
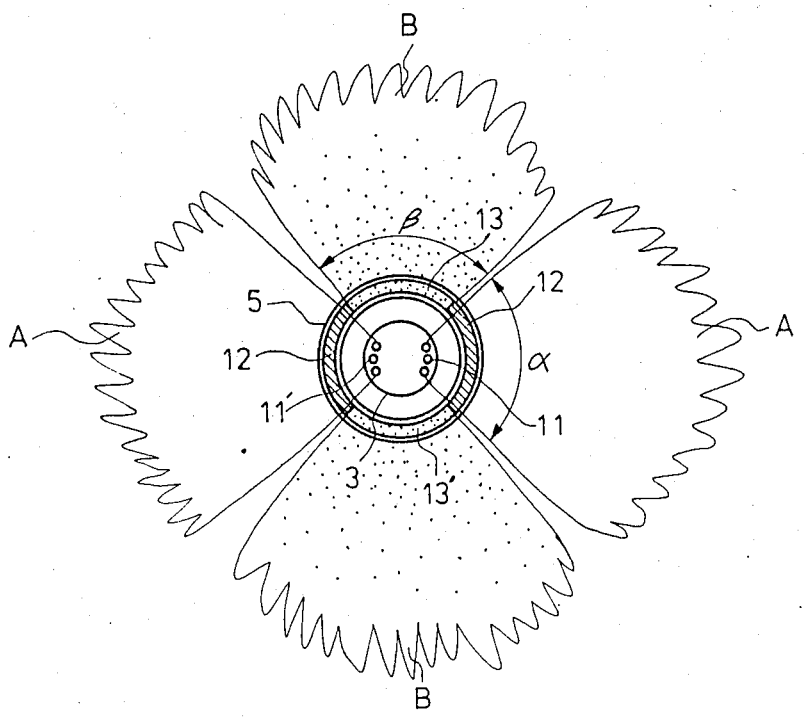
FIG. 5 illustrates a preferred embodiment of the present invention applied to the different fuels combustion burner shown in FIG. 1 and is a view looking in the direction indicated by an arrow V in FIG. 1.

FIG. 5 shows an embodiment in which the present invention is applied to the different fuels combustion burner of the type as shown in FIG. 1. The nozzle tip 3 is formed with liquid injection ports 11 and 11' which are symmetrical about the axis of the nozzle tip 3 and each of which comprises a plurality of openings disposed along an arc subtending a predetermined angle $\alpha$ to inject liquid fuel circumferentially over the angle $\alpha$. These openings may be equiangularly spaced apart from each other. The solid-fuel nozzle tip 5, which annularly surrounds the nozzle tip 3, is partly closed with closing or plug members 12 which are substantially in opposed relationship with the ports 11 and 11' so that solid-fuel injection ports 13 and 13' each subtending a predetermined angle $\beta$ are defined as the remaining unclosed portions of the nozzle tip 5. Therefore, according to the present invention, the liquid-fuel combustion flame A and the solid-fuel combustion flame B will not interfere with each other.

As described above, according to the present invenion, the liquid fuel injected from the liquid-fuel nozzle tip 3 will not interfere with the solid fuel injected from the solid-fuel nozzle tip 5 so that "COM" phenomenon can be prevented. In addition, according to the present invention, the liquid-fuel combustion flames A and the solid-fuel combustion flames B are separated from each other in the circumferential direction so that the solid fuel can be effectively heated and burned by the easy-to-burn liquid fuel. As a result, the combustion efficiency of the solid fuel can be remarkably increased. Furthermore, the ignitability of the solid fuel can be considerably improved so that the quantity of the liquid fuel used for igniting the solid fuel can be remarkably reduced.

It is to be understood that the present invention is not limited to the preferred embodiment described above and that various modifications may be effected. For example, the subtended angles $\alpha$ and $\beta$ as well as the numbers of the liquid- and solid fuel-injection ports may be suitably selected as needs demand.

The effects, features and advantages of the different fuels combustion burner in accordance with the present invention may be summarized as follows:

(i) Solid fuel injection and liquid fuel injection are separated in the circumferential direction so that the injected solid and liquid fuels will not interfere with each other and consequently "COM" phenomenon can be eliminated. As a result, the combustion efficiency of the solid fuel can be remarkably improved.

(ii) Ignitionability of the solid fuel can be much improved so that the consumption of the liquid fuel, which is an auxiliary fuel, can be reduced and consequently the different fuels combustion burner in accordance with the present invention is very economical.

(iii) The different fuels combustion burner in accordance with the present invention is simple in construction and is inexpensive to fabricate.

What is claimed is:

1. A burner for simultaneous combustion of liquid and solid fuels comprising a liquid-fuel combustion nozzle having a liquid fuel injection port for injecting liquid fuel into the burner circumferentially of said liquid fuel nozzle along an arc subtending a predetermined angle and a solid-fuel combustion nozzle having a solid fuel injection port for injecting a solid fuel into the burner circumferentially of said solid-fuel injection nozzle along a different arc subtending a predetermined angle, said solid-fuel nozzle surrounding and being coaxial with said liquid fuel nozzle, and said solid fuel nozzle being circumferentially closed by closing means disposed in substantially opposed relationship with said liquid-fuel injection port to define said solid-fuel injection port, whereby the injection ports of said nozzles are so separated circumferentially from one another that interference is prevented between the streams of solid and liquid fuels formed during injection thereof into the burner.

2. A burner according to claim 1, wherein said liquid-fuel injection port comprises a plurality of openings disposed along said arc subtending said predetermined angle.

* * * * *